US006280065B1

(12) United States Patent
Denningham

(10) Patent No.: US 6,280,065 B1
(45) Date of Patent: Aug. 28, 2001

(54) CORNER FLOOR LAMP

(76) Inventor: Robert Louis Denningham, 1116 Soho Ct., Crofton, MD (US) 21114

( * ) Notice: Subject to any disclaimer, the term of this patent is extended or adjusted under 35 U.S.C. 154(b) by 0 days.

(21) Appl. No.: 09/383,620

(22) Filed: Aug. 26, 1999

(51) Int. Cl.[7] ..... F21S 8/08

(52) U.S. Cl. ..... 362/414; 362/413; 362/410; 362/427; 362/430

(58) Field of Search ..... 362/410, 413, 362/414, 431, 427, 428, 430–432; 248/180.1, 188.2, 188.4

(56) References Cited

U.S. PATENT DOCUMENTS

| | | | |
|---|---|---|---|
| D. 328,361 | 7/1992 | Paproski . | |
| D. 337,391 | 7/1993 | Meck . | |
| D. 375,380 | 11/1996 | Lewis . | |
| D. 390,991 | 2/1998 | Cahill . | |
| D. 392,766 | 3/1998 | Gardere . | |
| 972,287 * | 10/1910 | Swift | 248/188.4 |
| 2,694,137 * | 11/1954 | Williams | 362/413 |
| 3,356,841 * | 12/1967 | Horan | 362/396 |
| 4,428,554 * | 1/1984 | Hartman | 248/415 |

OTHER PUBLICATIONS

Real Goods Catalog, holidays 1999, p. 74 Item A 35–418, Ott Floor Lamp.

* cited by examiner

*Primary Examiner*—Sandra O'Shea
*Assistant Examiner*—Ismael Negron
(74) *Attorney, Agent, or Firm*—Bacon & Thomas PLLC

(57) ABSTRACT

A floor lamp having a base with two sides that intersect in a ninety-degree angle for flush insertion in the corner of a room. A post or other vertical structure is attached to the base with a support device that supports a light fixture above the floor in the open space of the corner. In an alternative embodiment, a post or multiple posts or other support structure is fixed to the base and supports a light fixture flush with the walls of the corner of a room. A room can be illuminated with light diffusely reflected from a ceiling, as well as light radiated directly from the lamp.

3 Claims, 2 Drawing Sheets

CORNER FLOOR LAMP

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to a floor lamp, and more particularly to a floor lamp having a support base in which two sides form a ninety-degree angle, thus permitting the base to be placed flush with the baseboard or walls in the corner of a room.

2. Description of the Related Art

Many configurations of floor lamps are currently available. These lamps have vertical posts or support structures that typically are attached to the center of a circular base, or have legs that are symmetrically placed about the vertical post or support structure. Thus, these lamp bases cannot be placed flush in the corner of a room due to their circular shapes. Moreover, if the shades of these lamps are wider than, and centered over, the base, as is typically the case, the shade makes contact with the walls before the base does, preventing placement of the lamp deep in the corner of a room.

Some circular-based lamps have light fixtures that are held off-center. However, the vertical posts or support structures of these lamps cannot be placed deep into the corner of a room due to the circular shape of the base.

Also available are floor lamps that have square or elongated rectangular bases, some of which have off-center support posts and light fixtures. However, the off-center displacement of the light fixtures of these lamps is parallel to a pair of sides of the base, hence the light fixture is not suspended in the open space of the corner, but along one of the walls. Moreover, the physical dimensions of the shade of the light fixture will usually preclude placing the rectangular base snugly in the corner of a room.

Thus, currently available lamps do not make efficient use of floor space in corners of rooms that may be restricted by household furnishings, such as chairs, sofas, tables, beds, etc. Additionally, currently available floor lamps are not provided with bases that may be placed snugly in a corner of a room for purely aesthetic purposes.

BRIEF SUMMARY OF THE INVENTION

The present invention comprises a novel design of a floor lamp, wherein two sides of the base intersect at a ninety-degree angle for insertion of the base in the corner of a room; a post or other vertical support structure attached to the base at its lower end, supports a light fixture attached to the upper end.

The support structure can be designed to position the light fixture in the open space between the walls for conventional, direct illumination. Alternatively, the support structure can maintain a light fixture flush with the walls in a corner of a room to provide both direct illumination and diffuse illumination by reflected light from a ceiling.

Thus, an important object of the present invention is the provision of a floor lamp base that may be placed flush with the vertical surfaces in a corner of a room.

Another object of the present invention is the provision of a support structure attached to the base at its lower end, and to a light fixture at its opposite end, whose function is to position the light fixture in the open space in the corner of a room.

Yet another object of the present invention is the provision of a corner floor lamp for diffuse overhead illumination of a room, or for simultaneous diffuse overhead illumination and direct illumination.

The present invention, as described above, realizes a utility not present in currently available floor lamps, by means of a lamp base and light fixture support structure that permit the placing of floor lamps in confined spaces in corners of rooms. Moreover, beyond the practical applications of the present invention, it also provides for the placement of floor lamps snugly in the corners of rooms for purely aesthetic purposes.

BRIEF DESCRIPTION OF DRAWINGS

For the purpose of illustrating the invention, there are shown in the accompanying drawings alternative embodiments of corner floor lamps, and components of the floor lamps, it being understood that the invention is not intended to be limited to the precise arrangements shown.

DETAILED DESCRIPTION OF THE INVENTION

Figure 1:
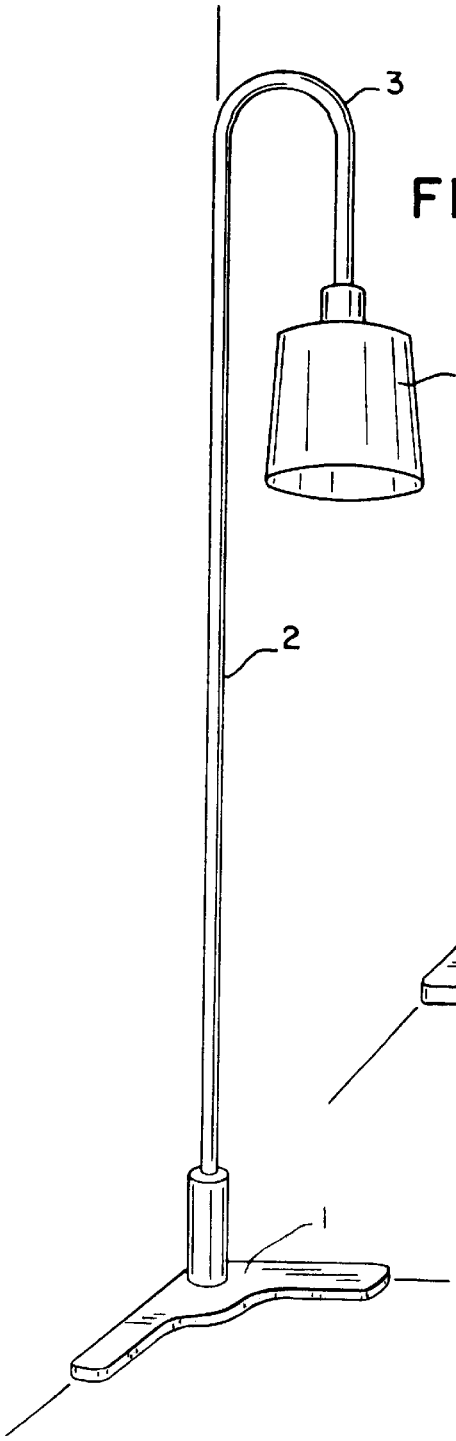
FIG. 1 is a perspective view of a particular embodiment of the present invention.
Figure 2:
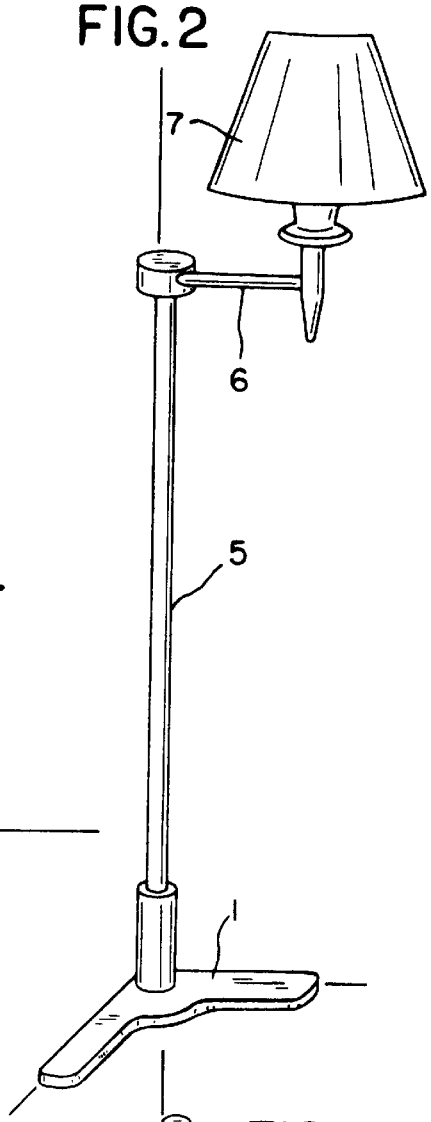
FIG. 2 is a perspective view of an alternative embodiment of the present invention.

Referring to FIGS. 1 and 2, there are shown two embodiments of the corner floor lamp, comprised of a base, indicated by numeral 1, support rods 2 and 5, and light fixtures 4 and 7. A neck 3 in the lamp of FIG. 1 provides for the suspension of the light fixture 4 in the open space in the corner of a room. The same function is likewise performed by the horizontal arm 6 in the lamp of FIG. 2.

The base 1 in these embodiments is a horizontal platform consisting of two extensions that form a ninety-degree angle and lie adjacent to the baseboard or walls of a room. The length of the extensions is calculated to oppose the torque exerted by the overhead weight of the lamp at the base. This is accomplished when the center of mass of the floor lamp is inside a line that connects the tips of the extensions. For bases in general, lamp equilibrium is established when the center of mass is inside the furthest extent of the base along the bisector of the ninety-degree angle, or, as in the geometry of base 1, is inside the projection of the extensions of the base on the bisector. The center of mass should also be as low as is practicable. This can be accomplished by concentrating weight in the lower extremity of the post and the base.

Figure 3:
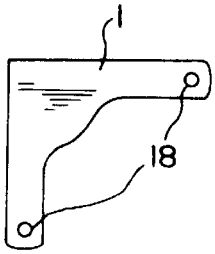
FIG. 3 is a bottom view of the base of FIGS. 1 and 2.

FIG. 3 is a bottom view of the base 1 in FIGS. 1 and 2, showing adjusting screws 18, which provide means for aligning the vertical supports 2 and 5 with the corner of a room.

Figure 4:
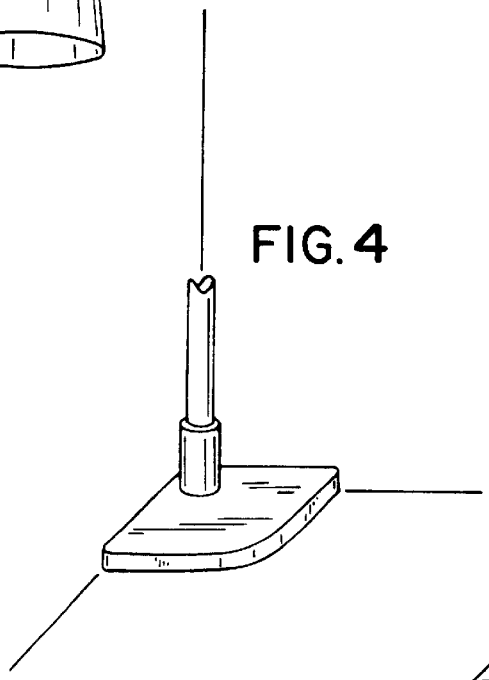
FIG. 4 is a fragmental perspective view of an alternative base for corner floor lamps.
Figure 5:
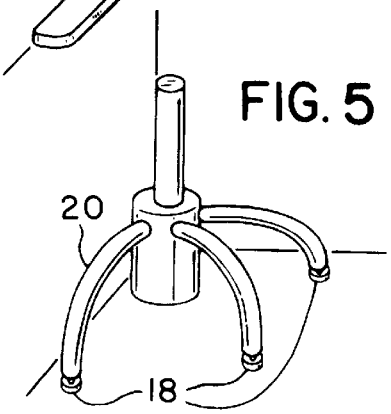
FIG. 5 is a fragmental view of an alternative embodiment of the base of a corner floor lamp wherein the lamp is supported by three legs and a post.

FIGS. 4 and 5 show alternative bases that may be substituted for base 1 in FIGS. 1 and 2. The base of FIG. 4 consists of a horizontal, ninety-degree sector of an ellipse or circle that can adjusted with leveling screws (not shown) in the same manner as base 1 of FIG. 3. The base in FIG. 5 is comprised of three legs 20 with adjusting screws 18, threaded into the bottoms of the legs 20.

Figure 6:
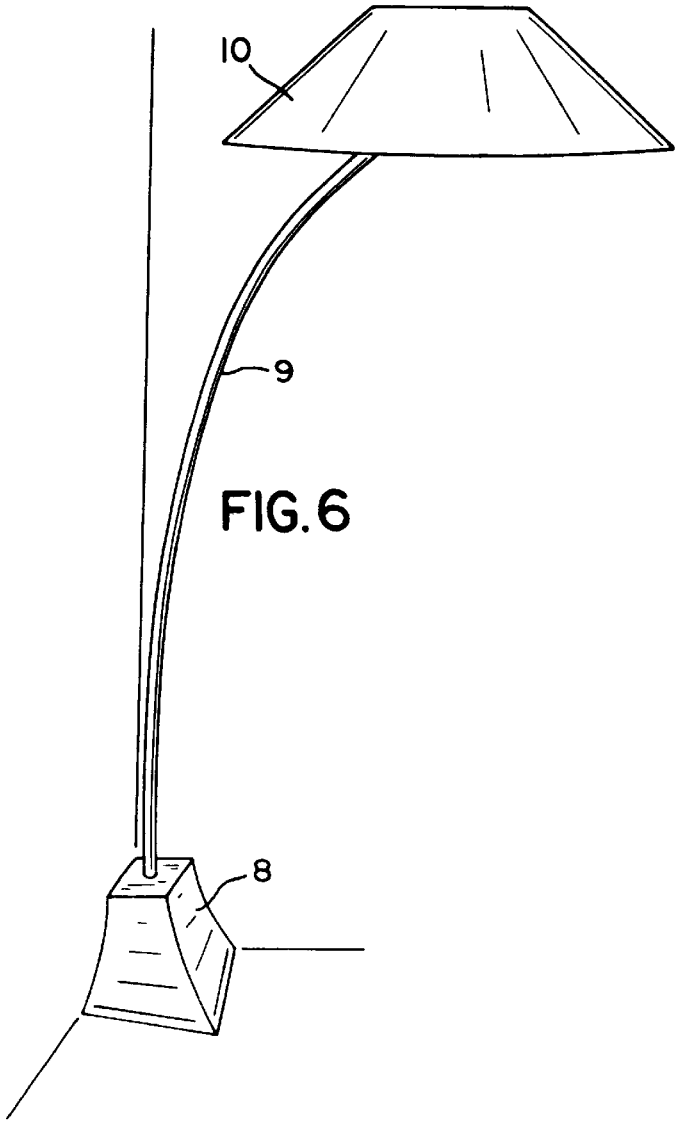
FIG. 6 is a perspective view of an alternative embodiment of the present invention having a bowed post and weighted base.
Figure 7:
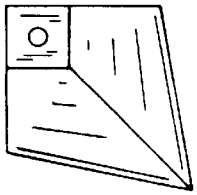
FIG. 7 is a top view of the weighted base of FIG. 6.

FIG. 6 shows another embodiment of the corner floor lamp, wherein the mass of the base 8 is a predominant factor in providing lamp equilibrium, allowing for a smaller base footprint. Provision for positioning the light fixture in the open space of the corner is accomplished by a bowed rod 9 that is inserted into the base 8 at its lower end, and supports the light fixture 10 at its upper end. FIG. 7 is a top view of the weighted base 8 of FIG. 6. The base 8 may be substituted for base 1 of FIGS. 1 and 2, and the bases shown in FIGS. 4 and 5.

Electrical power for the floor lamps of FIGS. 1, 2 and 6 can be provided by threading conducting wires through the posts or rods 2,5,9, respectively, that support the light fixtures.

Figure 8:
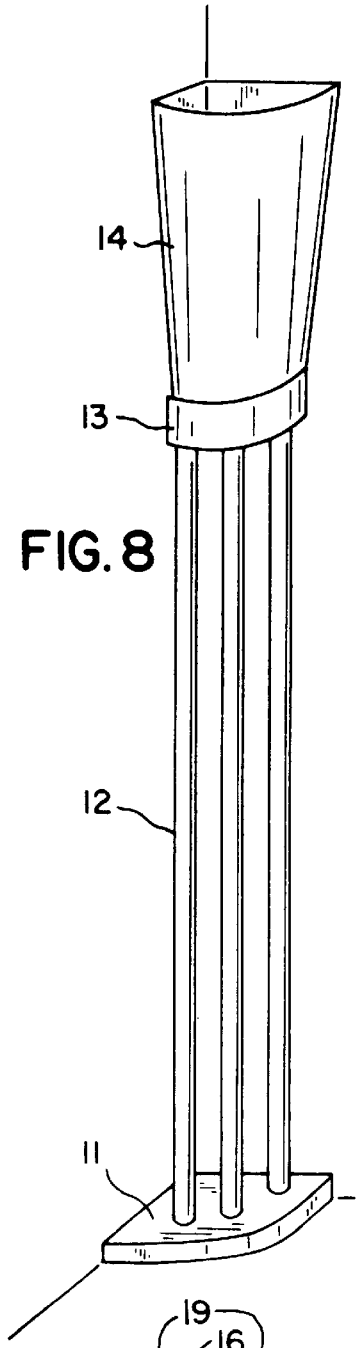
FIG. 8 is a perspective view of a corner lamp with the light fixture held in the corner of a room.

FIG. 8 shows an embodiment of the floor lamp with which a room can be illuminated simultaneously with overhead diffuse light and direct illumination. A transparent or translucent enclosure 14, open at the top, is detachable from a light fixture base 13. Light incident on the ceiling through the top of the enclosure is diffusely reflected back into the room, while direct light is transmitted into the room through the enclosure. Alternatively, the light fixture enclosure can be opaque, in which case the floor lamp is an overhead illuminator. The light fixture base 13 comprises a light bulb socket and light bulb 15, circumscribed by a band into which the light fixture enclosure 14 is inserted. The light fixture base 13 is attached to the upper ends of rods 12. The rods 12 in turn are attached to a horizontal base 11 at their lower ends. Electrical power for the illuminating source is provided by threading conducting wires through a supporting rod 12 to the light fixture base 13.

Figure 9:
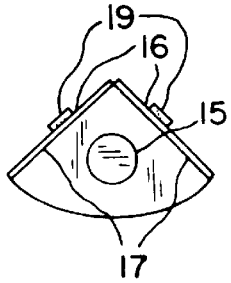
FIG. 9 is a top view of the light fixture of FIG. 8.

FIG. 9 is a top view of the light fixture with a light bulb 15 at its center. Heat insulation 16 is applied to the surfaces of the enclosure 14 that make contact with the wall. Reflective material 17 can be applied to the inner surfaces that are adjacent to the wall. Hook and loop fasteners 19, such as that available under the trademark velcro are attached to the surfaces of the enclosure, mate their disengageable sides with corresponding hook or loop patches attached to the walls of a room.

The present invention may be embodied in other specific forms without departing from the spirit of the essential attributes thereof, and accordingly reference should be made to the appended claims rather than the foregoing specifications as indicating the scope of the invention.

What I claim as my invention is:

1. A floor lamp comprising:

a base comprising two sides that connect to form a ninety-degree angle such that the base can be flush inserted in a corner of a room;

an adjusting device attached to the base to permit tilting of the base;

at least one post comprising upper and lower parts attached at the lower part to the base;

a light fixture;

the at least one post is a single vertical post or a plurality of vertical posts or other vertical support structure, including any ornamented structural support, attached at the lower part to the base, the upper part supporting the light fixture at its open end;

the light fixture further comprising a light source within a transparent, translucent or opaque enclosure having inner and outer plane faces;

heat insulating material on the outer plane faces of the enclosure;

light reflecting surfaces on the inner plane faces of the enclosure; and hook and loop fasteners affixed to the floor lamp and the fasteners are in alignment with and removable from corresponding hook and loop fasteners that are positionable on corner wall surfaces.

2. The floor lamp as recited in claim 1, wherein the enclosure is open at its top.

3. The floor lamp as recited in claim 1, wherein the plane faces intersect at a ninety-degree angle.

* * * * *